United States Patent [19]

Harris

[11] Patent Number: 4,543,914

[45] Date of Patent: Oct. 1, 1985

[54] FUEL PUMPING APPARATUS

[75] Inventor: Kenneth M. Harris, London, England

[73] Assignee: Lucas Industries Public Limited Company, Birmingham, England

[21] Appl. No.: 654,690

[22] Filed: Sep. 26, 1984

[30] Foreign Application Priority Data

Oct. 1, 1983 [GB] United Kingdom ..... 8326354

[51] Int. Cl.[4] ..... F02M 5/10; F28D 15/00

[52] U.S. Cl. ..... 123/41.31; 123/357

[58] Field of Search ..... 123/41.31, 357, 358, 123/359, 478; 165/51, 169, 80 A, 80 C

[56] References Cited

U.S. PATENT DOCUMENTS

| | | | |
|---|---|---|---|
| 3,157,828 | 11/1964 | Flaherty | 165/80 A |
| 3,196,926 | 7/1965 | Gartland | 123/41.31 |
| 3,267,333 | 8/1966 | Schultz | 165/80 A |
| 3,414,753 | 12/1968 | Hruda | 165/80 C |
| 3,528,492 | 9/1970 | Austin | 165/80 C |
| 3,551,758 | 12/1970 | Ferree | 165/80 C |
| 3,630,643 | 12/1971 | Eheim | 123/357 |
| 3,785,354 | 1/1974 | Moulds | 123/478 |
| 3,904,933 | 9/1975 | Davis | 165/80 C |
| 3,917,370 | 11/1975 | Thornton | 165/80 C |
| 3,965,971 | 6/1976 | Roggenkamp | 165/41 |
| 4,084,564 | 4/1978 | Rickert | 123/41.31 |
| 4,279,228 | 7/1981 | Mann | 123/357 |
| 4,364,355 | 12/1982 | Karino | 123/41.31 |
| 4,377,994 | 3/1983 | Lang | 123/357 |

*Primary Examiner*—Carl Stuart Miller

[57] ABSTRACT

A fuel pumping apparatus for supplying fuel to an internal combustion engine includes a pump having a body and a solenoid operated fuel control device. The current flow to the solenoid is controlled by a control circuit mounted on circuit boards located within an inner casing secured to the body. An outer casing surrounds the inner casing and defines a space which is connected with a fuel inlet, the space communicating with a fuel inlet of the pump. The flow of fuel through the space assists the cooling of the components of the control circuit.

15 Claims, 4 Drawing Figures

FUEL PUMPING APPARATUS

This invention relates to a fuel pumping apparatus for supplying fuel to an internal combustion engine, the apparatus comprising a fuel pump, solenoid operated means for controlling the output of the pump and an electronic control circuit for controlling the flow of electric current to the solenoid.

With such an apparatus it is possible to mount the electronic control circuit at a position removed from the pump. With such an arrangement a bulky wiring harness is required to effect the many electrical connections between the control circuit and the pump. If the electronic circuit is mounted on the pump the wiring harness is substantially eliminated, however, the cooling of certain components of the circuit for example power transistors, is made more difficult.

The object of the present invention is to provide such an apparatus in a simple and convenient form.

According to the invention an apparatus of the kind specified comprises in combination, an inner casing adapted to be mounted on the body of the pump, said electronic circuit being mounted in said inner casing, an outer casing surrounding said inner casing and defining a space therebetween, a fuel inlet on said outer casing, said fuel inlet communicating with said space and a fuel outlet from said space connected to the fuel inlet of the pump.

Figure 4:
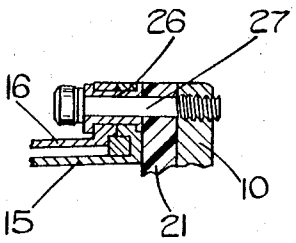
Figure 1:
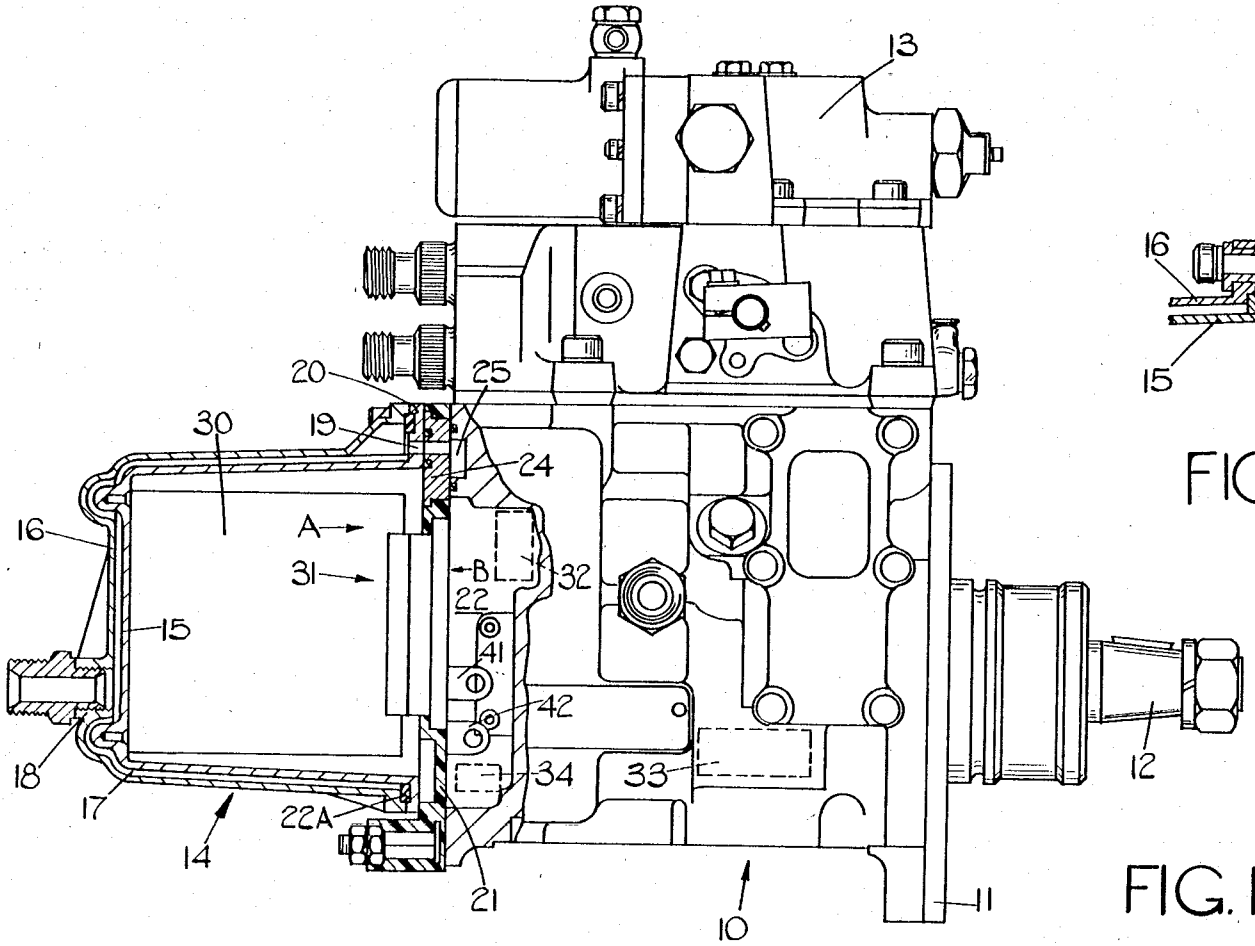
Figure 2:
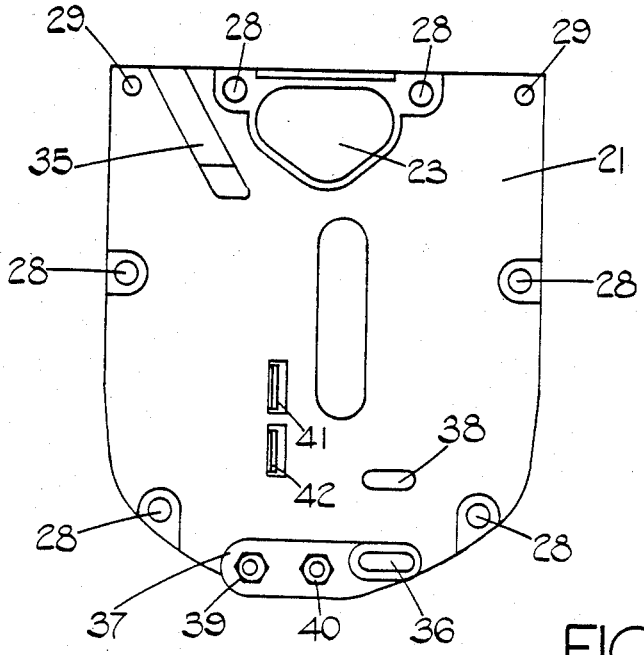
Figure 3:
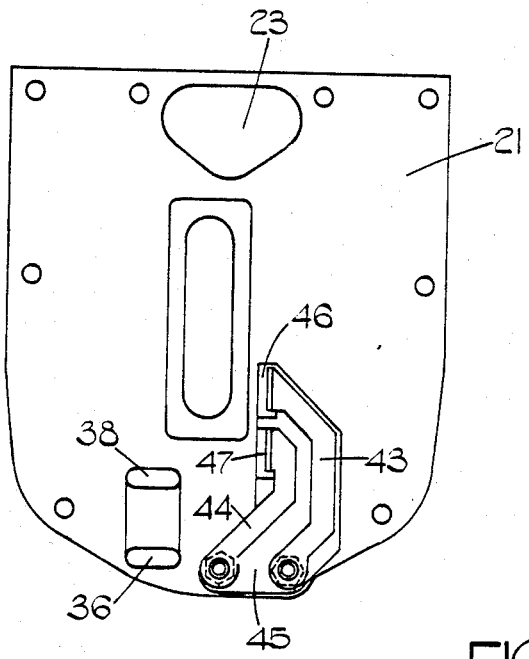

An example of a fuel pumping apparatus in accordance with the invention will now be described with reference to the accompanying drawings in which:

FIG. 1 is a diagrammatic side elevation of the apparatus with parts shown in section, FIG. 2 is an end view in the direction of the arrow A of FIG. 1 of part of the apparatus of FIG. 1, FIG. 3 is an end view of the part of the apparatus seen in FIG. 2 in the direction of the arrow B of FIG. 1, and FIG. 4 shows a constructional detail of the apparatus.

Referring to FIG. 1 of the drawings the apparatus includes a fuel pump which may be of the reciprocating plunger type and having a fuel distributor component whereby fuel delivered at high pressure by the reciprocating plunger can be diverted to a plurality of outlets in turn, the outlets in use, being connected to injection nozzles of the associated engine. The pump includes a body 10 which is provided with a mounting flange 11 through which extends a drive shaft 12 adapted in use, to be connected to a rotary part of the engine. The pump also includes at least one solenoid operated device shown in outlet at 13, whereby the amount of fuel delivered by the pump can be controlled. In addition, the pump is provided with a number of transducers which for example give signals indicative of the speed of operation of the pump and the position of the drive shaft and therefore the rotary parts of the engine. The signals provided by the transducers are supplied to an electronic control circuit which controls the flow of electric current in the solenoid operated device.

The electronic control circuit is conveniently mounted in a casing assembly 14 which is secured to the body 10 of the pump and the casing assembly comprises an inner casing 15 and an outer casing 16. Both casings are of hollow form having an open side and they are adapted to be retained relative to each other and to the body of the pump as will be explained. In the assembled condition of the casings a space 17 is defined therebetween and the outer casing is provided with a fuel inlet boss 18 which defines a fuel inlet to the space and which in use, is connected to a source of fuel. The fuel outlet from the space is defined by an aperture 19 formed in a flange 20 forming part of the inner casing 16.

The flange 20 of the inner casing 15 is held in engagement with a plate 21 which serves to close the open end of a chamber 22 defined in the body of the pump. The plate 21 is formed from electrical insulating material and it also forms a heat shield. The flange 20 defines a peripheral recess in which is located a sealing member 22A which establishes a seal between a flange on the outer casing 16 and the flange 20. The plate 21 is provide with a shaped opening 23 in which is mounted an insert 24. An aperture in the insert 24 provides a fuel connection between the aperture 19 and a fuel inlet 25 of the pump.

A sealing ring is located in a groove about the port forming the fuel transfer connection on the face of the insert presented to the flange 20 and a further sealing ring is located in a groove in the face of the body 10 presented to the plate 21. In this manner the risk of fuel gaining access to the interior of the inner casing 15 and the chamber 22 is minimized and the insulating plate is not exposed to fuel.

The flanges of the inner and outer casings 15, 16 are held in assembled relationship by means of tubular rivets 26 (FIG. 4) and in the completed assembly retaining screws 27 pass through the rivets, apertures 28 in the plate 21 and are engaged in threaded bores in the body 10, to retain the casings and plate relative to the body. Two further apertures 29 are provided in the plate 21 through which can extend screws (not shown) to retain the plate 21 to the casings during assembly.

The electronic circuit is mounted within the space defined by the inner casing 15 and the plate 21 and the components of the electronic circuit are mounted upon printed circuit boards 30 located in the inner casing in any convenient manner. The boards are held in position following assembly using potting compound which ensures that the components of the circuit which in use produce a substantial amount of heat, are in good heat exchange relationship with the casing. Items such for example as power transistors may be mounted on the inner casing. In use, fuel flowing through the space defined between the casings removes heat from the heated portions of the inner casing to maintain the hot components of the electronic circuit at a safe temperature. The outer surface of the inner casing may be provided with baffles which are positioned to direct the fuel over the hotter portions of the inner casing. It will be understood that the baffles could be formed on the inner surface of the outer casing.

It is necessary to effect certain electrical connections to the control circuit. During the potting process one part of a multiway connector 31 is secured in the inner casing at a position such that during assembly it can be coupled to the other part of the connector which is loosely housed in the chamber 22 and which is connected to various components in the pump body. The plate 21 is provided with a central aperture. The components include a demand transducer 32 which is operated by linkage connected to the throttle pedal of the vehicle, a speed transducer 33 which is positioned adjacent a rotary part of the pump and a preset resistor 34 the value of which is adjusted during calibration of the pump.

The connections to the solenoid operated device 13 from the control circuit are effected by means of a cable which locates in a groove 35 formed in the face of the plate 21 presented to the casings, the groove extending to the edge of the plate. There may be further connections to other components such for instance as a fuel temperature sensor and a position transducer the latter being associated with the device 13. The further connections can be effected through the aforesaid connector 31.

There will be connections to components which are removed from the pump such for example as an engine boost pressure sensor and/or an engine coolant temperature sensor and in addition there will be connections to control switches, diagnostic apparatus etc. Such connections are effected by means of a cable which is passed through an aperture 36 in a lower extension 37 of the plate 21. After passing through the aperture 36 the cable passes in a groove formed in the surface of the plate removed from the casings and then through a further aperture 38 into the space defined by the inner casing 15.

Separate connections are provided to the source of electric supply since the magnitude of the current can be high. As shown in FIGS. 2 and 3 the extension 37 mounts a pair of terminal posts 39, 40 for connection in use to a source of electric supply. The posts are connected respectively to tags 41, 42 which extend into the chamber 22 by means of shaped metal straps 43, 44 which are accommodated within a recess 45 formed in the face of the plate 21 presented to the chamber 22. The recess 45 may be filled with potting compound. A pair of through slots 46, 47 are formed in the plate and further tags (not shown) extend through the slots from the circuit boards and are secured to the tags 41, 42 when the plate 21 is secured to the casing parts.

By the construction described the components of the control circuit are cooled by the flow of fuel to the pump in use and in the event that the control circuit or pump becomes defective it is a simple matter to detach the casings and plate 21 to enable a new component to be fitted.

I claim:

1. A fuel pumping apparatus for supplying fuel to an internal combustion engine comprising a fuel pump including a fuel pump body, solenoid operated means for controlling the output of the pump, an electronic control circuit for controlling the flow of electric current in the solenoid, an inner casing adapted to be mounted on the body of the fuel pump, said electronic circuit being mounted in said inner casing, an outer casing surrounding said inner casing and defining a space therebetween, a fuel inlet on said outer casing, said fuel inlet communicating with said space, a fuel outlet from said space connected to the fuel inlet of the pump and a heat insulating and electrically insulating plate serving to close an open end of the inner casing, said plate being interposed between a peripheral flange on the inner casing and the body of the pump, an insert supported within an aperture in said plate, said insert defining the fuel outlet from said space, and a pair of sealing means located between said insert and the flange of said inner casing and the body respectively.

2. An apparatus according to claim 1 including a peripheral flange on the outer casing sealing means interposed between said flange and means for securing said flanges together.

3. An apparatus according to claim 2 in which said securing means comprises a plurality of tubular rivets spaced about said flanges.

4. An apparatus according to claim 3 in which said tubular rivets define apertures for the reception of screws respectively, said screws extending through corresponding apertures in the plate and being engaged within aligned threaded apertures in the pump body.

5. An apparatus according to claim 4 including means for retaining the plate relative to the flange of the inner casing during assembly.

6. An apparatus according to claim 4 in which the components of said control circuit are mounted upon boards mounted in said inner casing.

7. An apparatus according to claim 4 including a multiway electrical connector having one part secured within the inner casing the other part of the connector being engaged through an aperture in said plate with said one part of the connector prior to securing the casings to the body of the pump.

8. An apparatus according to claim 7 including a chamber defined in the pump body, said chamber being closed by said plate, and the other part of the connector being located in said chamber.

9. An apparatus according to claim 8 including electrical components mounted in said chamber said components being connected to said control circuit through electrical connections including said connector.

10. An apparatus according to claim 9 including a pair of power supply terminals mounted on said plate, said supply terminals in use being connected to a source of electric supply.

11. An apparatus according to claim 10 in which said control circuit includes a pair of tags which extend through respective through slots in said plate, said supply terminals being connected to said tags after the plate has been secured to the flange of the inner casing.

12. An apparatus according to claim 11 in which the connections between said tags and the supply terminals include shaped metal straps which are located within a recess defined in the face of the plate removed from said casings.

13. An apparatus according to claim 12 including a cable connection from said control circuit to said solenoid said cable connection extending along a groove extending to the edge of the plate and formed in the face of the plate presented to the casings.

14. An apparatus according to claim 13 including a further cable extending from said control circuit said further cable being connected to use to apparatus removed from the pump, said further cable extending from said control circuit through a further aperture formed in an extension of the plate.

15. An apparatus according to claim 14 in which said supply terminals are mounted on said extension.

* * * * *